US005993966A

United States Patent [19]

Johnson

[11] Patent Number: 5,993,966

[45] Date of Patent: Nov. 30, 1999

[54] CORD IMPREGNATED WITH RODENT REPELLENT

[75] Inventor: Marvin M. Johnson, Bartlesville, Okla.

[73] Assignee: Phillips Petroleum Company, Bartlesville, Okla.

[21] Appl. No.: 08/986,055

[22] Filed: Dec. 5, 1997

[51] Int. Cl.[6] ..... D02G 3/00

[52] U.S. Cl. ..... 428/377; 428/907; 424/412; 52/517

[58] Field of Search ..... 52/517; 424/412–411; 405/157; 428/377, 378, 375, 907

[56] References Cited

U.S. PATENT DOCUMENTS

| | | | |
|---|---|---|---|
| 2,792,394 | 5/1957 | Himel et al. | 260/247.1 |
| 2,822,295 | 2/1958 | Barrett et al. | 117/138.5 |
| 2,862,850 | 12/1958 | Goodhue | 167/46 |
| 3,448,586 | 6/1969 | Mailen et al. | 61/72.1 |
| 3,503,800 | 3/1970 | Eddy | 117/218 |
| 3,740,201 | 6/1973 | Woodruff | 106/18.32 |
| 4,058,402 | 11/1977 | Stansbury et al. | 106/16 |

*Primary Examiner*—Alexander Thomas
*Attorney, Agent, or Firm*—Ryan N. Cross

[57] ABSTRACT

A cord is impregnated with a rodent repellent such as an N,N-dialkyl-sulfenyl dithiocarbamate. The impregnated cord can be positioned along an elongated member, such as a buried electric cable, to protect the elongated member from damage by rodents. Preferably, the cord is wrapped around the elongated member to form a coil along the length of the elongated member.

16 Claims, 1 Drawing Sheet

CORD IMPREGNATED WITH RODENT REPELLENT

BACKGROUND OF THE INVENTION

The invention relates to the protection of rodent-damageable members, such as buried electric cables, against attack by rodents.

An electric cable comprises at least one conductor and an outer covering of insulative material, typically a plastic. The insulative material is subject to attack by rodents such as gophers. Applying a rodent repellent directly to the insulative material for its protection has not been feasible, since the rodent repellent tends to compromise the mechanical integrity of the insulative material by causing cracks and deterioration. It is also difficult to uniformly apply the rodent repellent to the insulative covering of the electric cable.

SUMMARY OF THE INVENTION

It is, therefore, an object of the invention to provide a means of protecting a rodent-damageable member, such as an electric cable, which does not structurally degrade the member and which is easy to uniformly implement for use.

According to one aspect of the invention, there is provided a method of protecting an elongated member (in the illustrated embodiment an electric cable) from damage by rodents comprising: positioning a cord impregnated with rodent repellent, in an amount sufficient to effectively repel rodents, along the elongated member so as to be in contact with or closely adjacent to the elongated member.

According to another aspect of the invention, there is provided an article comprising: a rodent-damageable elongated member (in the illustrated embodiment an electric cable); a cord impregnated with rodent repellent, in an amount sufficient to effectively repel rodents, which is wrapped around and in contact with the elongated member to form a coil along the length of the elongated member.

According to yet another aspect of the invention, there is provided a cord impregnated with an N,N-dialkyl-sulfenyl dithiocarbamate in an amount sufficient to effectively repel rodents.

BRIEF DESCRIPTION OF THE DRAWINGS

FIGS. 1 and 2 are several times larger in scale than an actual cord for clarity of illustration.

DETAILED DESCRIPTION OF THE INVENTION

Figure 2:
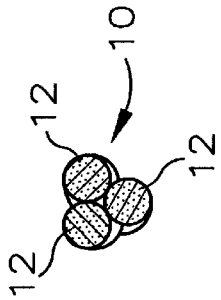
FIG. 1 is a view of a cord and FIG. 2 is a cross-sectional view of the cord along line 2—2 which schematically shows with dots its impregnation with rodent repellent.
Figure 1:
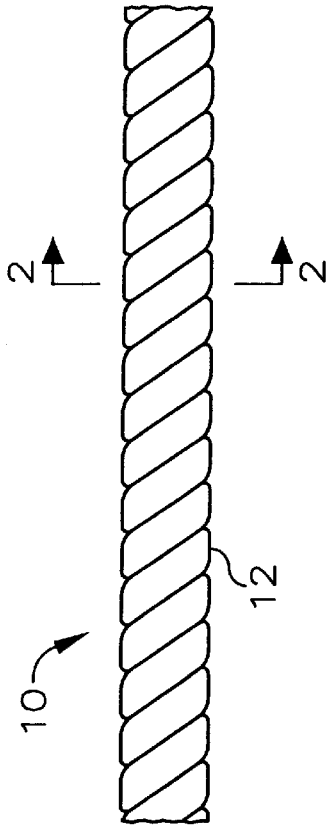

Referring to FIGS. 1 and 2, a cord 10, such as a string or twine, is shown as being comprised of strands 12. Although the illustrated embodiment has three strands, cord 10 could have any number of strands. The material of cord 10 is not particularly critical, as long as it will effectively absorb rodent repellent solution (as further discussed below). Possible materials for the cord include cotton and a cotton/polyester blend. Decomposition of cord 10 can even be allowed in an underground application, where the rodent repellent will be left behind and mix in with the soil. The size of cord 10 is also not critical, as long as breakage is prevented during implementation.

As indicated above, dots in FIG. 2 schematically indicate impregnation of the strands of cord 10 with rodent repellent. Preferably, as shown, each strand 12 is impregnated with rodent repellent uniformly through its cross section. The rodent repellent is preferably an N,N-dialkyl-sulfenyl dithiocarbamate, more specifically an N,N-dimethyl-sulfenyl dithiocarbamate such as N,N-dimethyl-S-methylsulfenyl dithiocarbamate or N,N-dimethyl-S-tert-butylsulfenyl dithiocarbamate. Cord 10 is impregnated with the rodent repellent in an amount sufficient to effectively repel rodents, preferably about 40–250 milligrams per linear foot of cord.

Cord 10 is preferably impregnated with rodent repellent by employing a rodent repellent solution. The rodent repellent is dissolved in a suitable hydrocarbon solvent, preferably a $C_5$–$C_{12}$ hydrocarbon, and most preferably a $C_6$ or $C_7$ hydrocarbon. Preferred hydrocarbon solvents include cyclohexane, methylcyclohexane, and isoheptane. A mixture of hydrocarbons could also be used, such as gasoline. The concentration of rodent repellent in the solution is typically in the range of about 0.5–20 weight percent (based on the total weight of the solution), but the specific concentration must be adjusted to obtain the desired milligrams of rodent repellent per linear foot of cord. The cord is passed continuously through and is immersed in a bath of the solution for a time sufficient to allow uniform absorption of the solution. Usually, only about a second of immersion is required. The cord is then passed through a dryer at a preferred temperature of about 80°–250° F. to result in evaporation of the solvent. The evaporated solvent can be appropriately burned or recovered. The impregnated cord can now be wound onto a spool for subsequent implementation.

Figure 3:
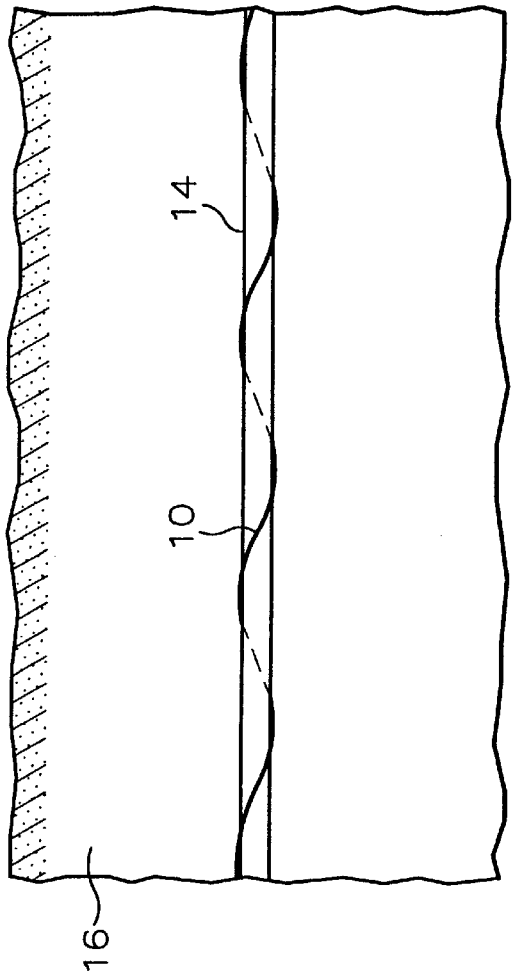
FIG. 3 is a view of a buried electric cable wrapped with the impregnated cord.

Referring now to FIG. 3, an electric cable 14 is shown as being buried in the ground 16, and cord 10 is shown as being positioned along electric cable 14 to accordingly protect it from damage by rodents. Preferably, cord 10 is wrapped around and in contact with electric cable 14 to form a coil along the length of the cable. The coil preferably comprises one turn of cord for about 1–10 linear feet of cable, and most preferably comprises one turn of cord for about 2–5 feet of cable.

Electric cable 14 and cord 10 are installed as shown in FIG. 3 by first digging a trench in the ground to the desired depth, wrapping cord 10 around electric cable 14 as both are most conveniently dispensed from the back of a truck, laying electric cable 14 and cord 10 as wrapped around the cable in the trench, and then filling in the trench to bury the electric cable 14 and cord 10. The wrapping operation can be performed by any suitable mechanical wrapping means or even by hand.

Figure 4:
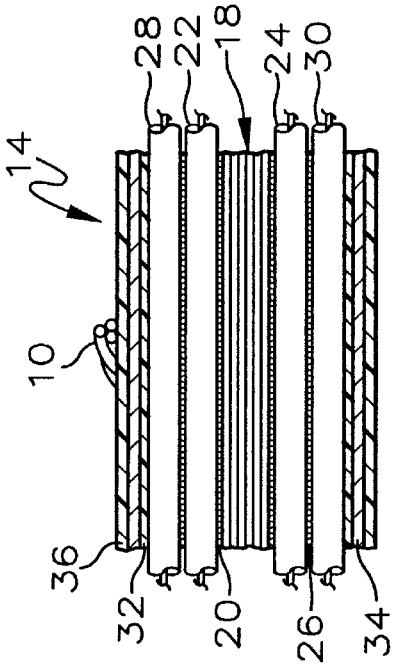
FIG. 4 is a longitudinal cross-sectional view of the electric cable enlarged in scale from that of FIG. 3.

Referring now to FIG. 4, electric cable 14 is shown in the illustrated embodiment as being a coaxial transmission cable having a number of "coaxials" therein. Only four of the coaxials are shown in FIG. 4. Each coaxial comprises a bendable copper tube and a conductor extending therethrough and held in place by insulative spacers (not shown). Of course, the invention could be applied to any type of electric cable. Electric cable 14 is shown as including central insulated conductors 18, paper wrap 20, coaxials 22 and 24, paper wrap 26, coaxials 28 and 30, a plastic layer 32, a lead layer 34, and an outer, preferably plastic (i.e. polyethylene), insulative covering 36. Cord 10 effectively protects insulative covering 36 against attack by rodents.

obviously, many modifications and variations of the present invention are possible in light of the above teachings. For example, instead of being wrapped around the electric cable, one or more impregnated cords could simply be laid beside the cable, contacting the cable or at least being closely adjacent thereto (generally not more than 2 or 3 inches away). Also, the impregnated cord could be used to protect other elongated members, such as plastic conduits, or even other objects subject to attack by rodents such as trees, grain sacks, nursery stock, etc. by, for example, wrapping a length of cord around the object. It is, therefore, to be understood that within the scope of the appended claims, the invention may be practiced otherwise than as specifically described.

That which is claimed is:

1. A method of protecting an elongated member from damage by rodents comprising: positioning a cord impregnated with rodent repellent, in an amount sufficient to effectively repel rodents, along the elongated member so as to be in contact with or closely adjacent to the elongated member.

2. A method as recited in claim 1 wherein the rodent repellent is an N,N-dialkyl-sulfenyl dithiocarbamate.

3. A method as recited in claim 2 wherein the rodent repellent is an N,N-dimethyl-sulfenyl dithiocarbamate.

4. A method as recited in claim 3 wherein the rodent repellent is N,N-dimethyl-S-methylsulfenyl dithiocarbamate or N,N-dimethyl-S-tert-butylsulfenyl dithiocarbamate.

5. A method as recited in claim 4 wherein the rodent repellent is present in the cord in the amount of about 40–250 milligrams per linear foot of cord.

6. A method as recited in claim 5 wherein the cord is wrapped around and in contact with the elongated member to form a coil along the length of the elongated member.

7. A method as recited in claim 6 wherein the coil comprises one turn of cord for about 1–10 linear feet of the elongated member.

8. A method as recited in claim 7 wherein the elongated member is an electric cable.

9. A method as recited in claim 8 wherein the electric cable and cord as positioned along the electric cable are buried in the ground.

10. An article comprising:

a rodent-damageable elongated member; and a cord impregnated with rodent repellent, in an amount sufficient to effectively repel rodents, which is wrapped around and in contact with the elongated member to form a coil along the length of the elongated member.

11. An article as recited in claim 10 wherein the rodent repellent is an N,N-dialkyl-sulfenyl dithiocarbamate.

12. An article as recited in claim 11 wherein the rodent repellent is an N,N-dimethyl-sulfenyl dithiocarbamate.

13. An article as recited in claim 12 wherein the rodent repellent is N,N-dimethyl-S-methylsulfenyl dithiocarbamate or N,N-dimethyl-S-tert-butylsulfenyl dithiocarbamate.

14. An article as recited in claim 13 wherein the rodent repellent is present in the cord in the amount of about 40–250 milligrams per linear foot of cord.

15. An article as recited in claim 14 wherein the coil comprises one turn of cord for about 1–10 linear feet of the elongated member.

16. An article as recited in claim 15 wherein the elongated member is an electric cable.

* * * * *